US008584862B2

(12) United States Patent
Danov et al.

(10) Patent No.: US 8,584,862 B2
(45) Date of Patent: Nov. 19, 2013

(54) METHOD FOR CONTINUOUS MAGNETIC ORE SEPARATION AND/OR DRESSING AND RELATED SYSTEM

(75) Inventors: Vladimir Danov, Erlangen (DE); Imme Domke, Mannheim (DE); Bernd Gromoll, Baiersdorf (DE); Werner Hartmann, Weisendorf (DE); Wolfgang Krieglstein, Nürnberg (DE); Alexej Michailovski, Ludwigshafen (DE); Norbert Mronga, Dossenheim (DE); Reinhold Rieger, Mutterstadt (DE)

(73) Assignees: Siemens Aktiengesellschaft, Munchen (DE); BASF SE, Ludwigshafen (DE)

( * ) Notice: Subject to any disclaimer, the term of this patent is extended or adjusted under 35 U.S.C. 154(b) by 0 days.

(21) Appl. No.: 13/392,504

(22) PCT Filed: May 31, 2010

(86) PCT No.: PCT/EP2010/057542

§ 371 (c)(1),
(2), (4) Date: Apr. 13, 2012

(87) PCT Pub. No.: WO2011/023426

PCT Pub. Date: Mar. 3, 2011

(65) Prior Publication Data

US 2012/0189512 A1 Jul. 26, 2012

(30) Foreign Application Priority Data

Aug. 24, 2009 (DE) ..... 10 2009 038 666

(51) Int. Cl.
*B03C 1/00* (2006.01)

(52) U.S. Cl.
USPC ..... 209/8; 209/9; 209/39; 209/47; 209/49; 209/214; 423/151; 423/152

(58) Field of Classification Search
USPC ..... 209/8, 9, 39, 47, 49, 214; 423/1, 151, 423/152; 23/313 R
See application file for complete search history.

(56) References Cited

U.S. PATENT DOCUMENTS 2,539,486 A * 1/1951 Scott ..... 209/17
3,926,789 A 12/1975 Shubert ..... 209/8

(Continued)

FOREIGN PATENT DOCUMENTS

WO 96/41391 12/1996 ..... H01M 8/00
WO 02/066168 * 8/2002

(Continued)

OTHER PUBLICATIONS

Wang, et al., "Hydrophohic magnetite seeding of hematite ultrafines in high gradient magnetic separation", Minerals Engineering, vol. 6, No. 5, pp. 537-546. 1993.*

(Continued)

*Primary Examiner* — Steven Bos
(74) *Attorney, Agent, or Firm* — King & Spaulding L.L.P.

(57) ABSTRACT

A method for magnetic ore separation and/or dressing is provided, in which metalliferous recoverable materials are separated from conveyed metalliferous ore rock. The method may include producing a pulp including metalliferous recoverable material, executing a hydrophobizing reaction of recoverable material in the pulp, synthesizing a hydrophobized, magnetizable material in liquid suspension and adding this suspension to the pulp, causing an agglomeration reaction between hydrophobized magnetizable material and hydrophobized recoverable material to form magnetizable agglomerates in the pulp, separating the magnetizable agglomerates from the pulp, mixing separation products containing the agglomerates with a non-polar liquid insoluble in water and decomposing the agglomerates in the non-polar liquid into magnetizable material and recoverable material, separating the magnetizable material from the recoverable material, and removing moisture from the separation portion containing the recoverable material of the second separation stage to synthesize the recoverable material.

10 Claims, 2 Drawing Sheets

(56) References Cited

U.S. PATENT DOCUMENTS

| | | | | |
|---|---|---|---|---|
| 4,002,463 | A | 1/1977 | Nestoridis | 75/1 R |
| 4,643,822 | A | 2/1987 | Parsonage | 209/8 |
| 4,657,666 | A * | 4/1987 | Snook et al. | 209/8 |
| 2010/0200510 | A1 | 8/2010 | Domke et al. | 210/679 |
| 2010/0300941 | A1 | 12/2010 | Domke et al. | 209/8 |

FOREIGN PATENT DOCUMENTS

| | | | | |
|---|---|---|---|---|
| WO | 2007/008322 | * | 1/2007 | |
| WO | 2009/010422 | A1 | 1/2009 | C22B 1/00 |
| WO | 2009/030669 | A2 | 3/2009 | B03C 1/015 |

OTHER PUBLICATIONS

Gray, et al., "Recovery of fine gold particles by flocculation with hydrophobic magnetite", Extractive Metallurgy Conference, Perth, Oct. 2-4, 1991, pp. 223-226.*

International PCT Preliminary Report on Patentability, PCT/EP2010/057542, 7 pages, Oct. 6, 2011.

* cited by examiner

METHOD FOR CONTINUOUS MAGNETIC ORE SEPARATION AND/OR DRESSING AND RELATED SYSTEM

CROSS-REFERENCE TO RELATED APPLICATIONS

This application is a U.S. National Stage Application of International Application No. PCT/EP2010/057542 filed May 31, 2010, which designates the United States of America, and claims priority to DE Patent Application No. 10 2009 038 666.1 filed Aug. 24, 2009. The contents of which are hereby incorporated by reference in their entirety.

TECHNICAL FIELD

The present disclosure relates to methods for continuous magnetic ore separation and/or dressing. For example, the method may include a dressing of the materials used and a reintroduction into the method process. Furthermore, the disclosure relates to associated systems for performing such methods, which may be carried out with corresponding units/devices on an industrial scale.

BACKGROUND

In the relevant mining/dressing technology, ore is understood to mean metalliferous rock from which the metalliferous components are to be separated as recoverable materials. Especially in the case of copper ores, the recoverable materials are in particular sulfide copper materials which are to be enriched, for example—but not exclusively—$Cu_2S$. The Cu-free rock surrounding the material grains is referred to as matrix rock or gangue, among experts after grinding of the rock also as tailing or hereinafter for short as sand.

According to typical conventional methods for ore separation are already known which can be performed continuously if necessary. However, these methods mainly operate according to the principle of mechanical flotation, wherein the ground rock is mixed with water in order to be able to process it further. This mixture of water and rock flour is also referred to as pulp. The rich ore particles contained in the pre-ground rock in the pulp are first selectively given a hydrophobic coating with the aid of chemical additives and then concentrated into froth by bonding to bubbles. The mixture of rich ore particles, bubbles and water thus formed can then simply be carried away in the overflow of so-called flotation cells.

In typical conventional methods, to achieve a high level of extraction of the rich ore content from the rock, i.e. a high yield, several consecutive separation stages may be necessary, each of which contain their own flotation cells. However, overall this may be associated with high expenditure and, in addition, particularly high energy consumption.

Magnetically assisted ore extraction methods have also already been proposed but as discontinuously performed operations. As a result of execution as a discontinuously operating batch method, the yield and the associated efficiency may be limited, which may have an effect on costs.

Additional methods such as drum separators, for example, may operate continuously but may have only small flow rates due to the mechanical expenditure and maintenance required and may therefore be unsuitable for many of the ore extraction methods used in mining.

Further, methods for the continuous separation of non-magnetic ores using magnetic or magnetizable particles have been proposed, e.g., in the following non-prepublished German patent applications from Siemens AG: DE102008047841 and DE102008047842; as well as the published WO2009030669A2 from BASF AG.

SUMMARY

In some embodiments an overall process for continuous magnetic ore separation is provided, and in particular, for the subsequent recycling of the materials used. Further, a suitable system for this purpose can be realized in practice on an industrial scale, for example.

Some embodiments relate to a continuously operating method for magnetic ore separation and/or dressing including recycling of the most important materials used. This produces a particularly environmentally friendly and economic overall method for continuous ore separation particularly of non-magnetic ores with the aid of magnetic particles, which method can replace conventional expensive flotation methods.

Some embodiments of the method have lower energy requirements and a greater extraction yield than certain conventional methods and can in particular separate ore particles in a wider particle size range than is possible according to certain conventional methods. It is advantageous that a whole system can be assembled as much as possible from technical units and/or devices already available. In conjunction with the technical device for magnetization/demagnetization, in which the magnetized solid particle flows are separated from the respective liquid flow or the suspension, quite considerable improvements are achieved.

In one embodiment, a method for magnetic ore separation and/or dressing, in which metalliferous recoverable materials are separated from conveyed metalliferous ore rock, is provided. In that embodiment, the method includes: production of a liquid mixture (pulp) comprising water and ground rock, which contains the metalliferous recoverable material, execution of a hydrophobizing reaction of at least one recoverable material in the pulp, synthesis of a hydrophobized, magnetizable material in liquid suspension and addition of this suspension to the pulp, bringing about of an agglomeration reaction between hydrophobized magnetizable material and hydrophobized recoverable material to form magnetizable agglomerates in the pulp, a first magnetic separation stage to separate the magnetizable agglomerates from the pulp, mixing of one of the separation products of the first separation stage, containing the agglomerates, with a non-polar liquid insoluble in water and decomposition of the agglomerates in the non-polar liquid into the basic components of magnetizable material and recoverable material, a second magnetic separation stage to separate the magnetizable material from the recoverable material, and removal of moisture from the separation portion containing the recoverable material of the second separation stage to synthesize the recoverable material.

In a further embodiment, magnetite ($Fe_3O_4$) may be used as a magnetizable material. In a further embodiment, a hydrophobizing agent may be used for selective hydrophobization of the metalliferous recoverable materials of the pulp. In a further embodiment, that diesel oil may be used as a non-polar liquid. In a further embodiment, the materials used—magnetizable material, non-polar liquid and/or process water—may be recycled. In a further embodiment, moisture may be removed from a material flow of the second magnetic separation stage which comprises the magnetizable material and the magnetizable material from which moisture is removed is used to create the suspension. In a further embodiment, xanthates may be used as hydrophobizing agents. In a further embodiment, the pulp may have a water content of 30 to 60 percent by mass. In a further embodiment, the pulp may be pumped. In a further embodiment, additional chemicals may be used in the pulp.

In another embodiment, a system including at least one agitator device, associated pumps and at least one magnetic separator is provided for performing a method including: production of a liquid mixture (pulp) comprising water and ground rock, which contains the metalliferous recoverable material, execution of a hydrophobizing reaction of at least one recoverable material in the pulp, synthesis of a hydrophobized, magnetizable material in liquid suspension and addition of this suspension to the pulp, bringing about of an agglomeration reaction between hydrophobized magnetizable material and hydrophobized recoverable material to form magnetizable agglomerates in the pulp, a first magnetic separation stage to separate the magnetizable agglomerates from the pulp, mixing of one of the separation products of the first separation stage, containing the agglomerates, with a non-polar liquid insoluble in water and decomposition of the agglomerates in the non-polar liquid into the basic components of magnetizable material and recoverable material, a second magnetic separation stage to separate the magnetizable material from the recoverable material, and removal of moisture from the separation portion containing the recoverable material of the second separation stage to synthesize the recoverable material.

In a further embodiment, the agitator device and the dosing pump may be present severalfold, the devices being connected in series. In a further embodiment, a magnetic separator may be present severalfold, the devices being connected in series. In a further embodiment, the system may include an additional magnetic separator designed to separate the flow of magnetizable particles from the rich ore particles magnetically. In a further embodiment, the separator may have at least one drying stage to remove moisture from the recoverable material flow.

BRIEF DESCRIPTION OF THE DRAWINGS

Example embodiments will be explained in more detail below with reference to figures, in which.

DETAILED DESCRIPTION

Figure 1:
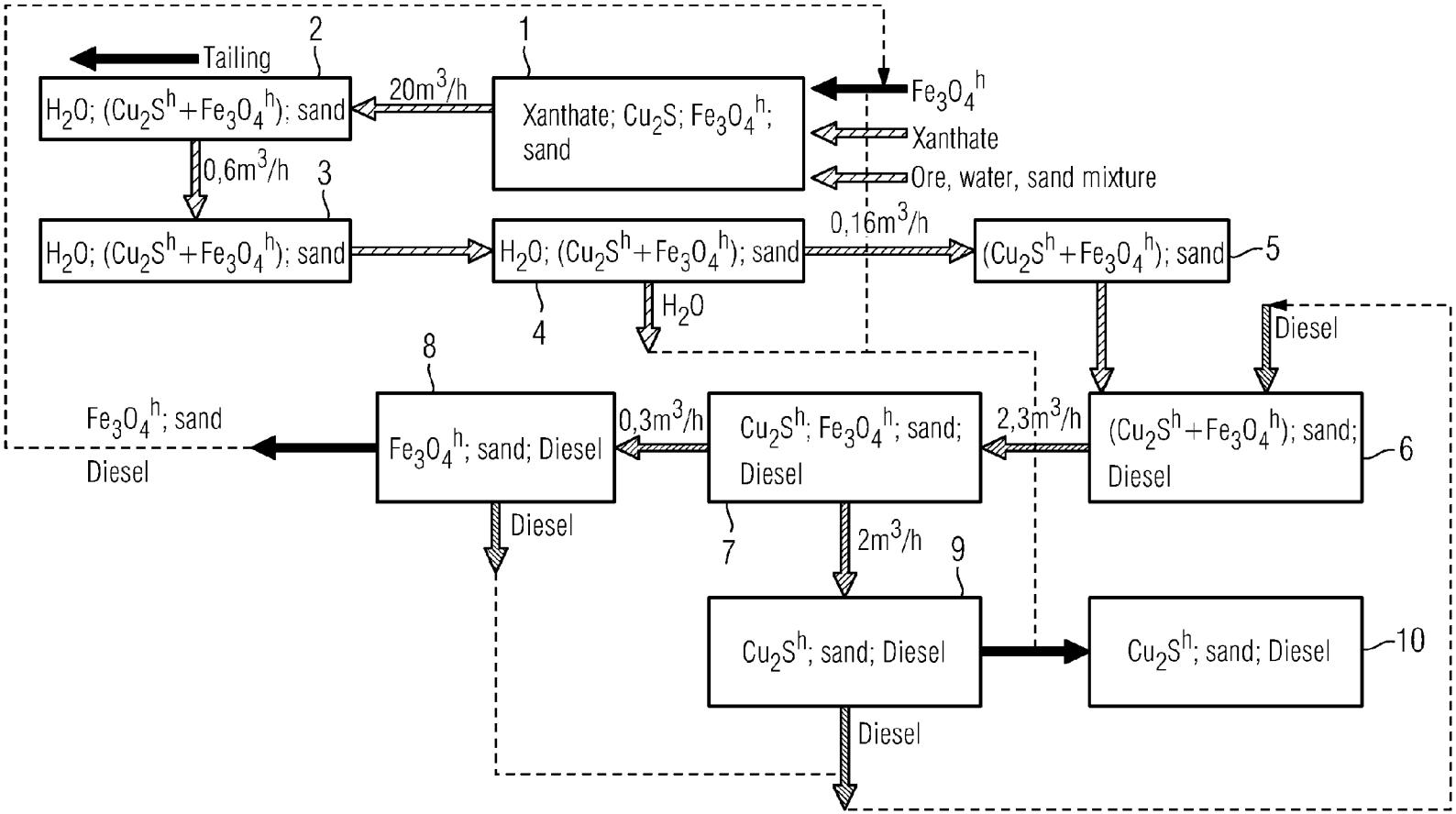
FIG. 1 is a diagram showing function boxes for method steps with individual material flows in an example method, according to an example embodiment.

In FIG. 1 the individual method sections are each entered in boxes with the associated chemical composition, wherein the bold arrows identify the respective sequence of the method sections and the dotted lines with the respective arrows identify the material flows from the recycled material.

In some embodiments, magnetite ($Fe_3O_4$) is used as a magnetically activatable sorbent: magnetite is already hydrophobic in finely ground form, i.e. it preferably bonds to hydrophobic particles in aqueous solutions.

The magnetite to be used furthermore is treated in finely ground form with a surface-modifying agent which makes the surfaces of the particles substantially more hydrophobic, i.e. water-repellent. Hydrophobic particles bond together in aqueous suspension to form agglomerates in order to minimize the interface with water. This is exploited such that the rich ore particles is likewise selectively hydrophobized but the gangue remains hydrophilic; as a result larger agglomerates are formed from rich ore particles and magnetite, which can be magnetized as a whole due to the magnetite content.

In the method described below the magnetic properties of the magnetite are used to that effect to enable the magnetite with the rich ore particles bonded thereto to be separated from the non-magnetic materials (gangue) using defined positioned and/or activatable magnetic fields. Below sulfide copper minerals are cited by way of example, it also being possible for the method to be used for other sulfide minerals such as e.g. molybdenum sulfide, zinc sulfide. Through adjustment of the functional group of the hydrophobizing agent for other minerals, the method described here can also be used for minerals of other chemical composition.

A long-chain potassium or sodium alkyl xanthate (hereinafter referred to as "xanthate" for the sake of simplicity) is used as an additive at the beginning of the process chain of the method. This is an agent which is known to selectively adsorb sulfide copper minerals to the surfaces and make them hydrophobic. Xanthate usually comprises a carbon chain with typically 5 to 12 carbon atoms and a functional head group which bonds selectively to the copper mineral.

In the present case the rich ore particles are hydrophobed as a result. To this end the ore in finely ground form as well as water and diesel oil are used as input materials for the process described below.

According to box 1 the input materials are mixed in a first process step. The ore flow (pulp), which consists of the ground rock (ore), water and—depending on the application—different chemicals, is mixed with the requisite magnetite which has already been hydrophobed and the additional hydrophobizing agent, in particular xanthate. Preferably, the ore flow has a solid content percentage by mass of approximately 40 to 70%, which means the flow can be pumped and in accordance with FIG. 2 can be fed into a mixing container or agitator vessel 26 by means of a pump 25.

In some embodiments, the aim is for the copper minerals hydrophobed by xanthate, such as for example chalcocite ($Cu_2S$), bornite ($Cu_5FeS_4$) or ehalcopyrite ($CuFeS_2$), to form agglomerates with the hydrophobic magnetite ($Fe_3O_4$) due to their water-repellent properties in an aqueous suspension (pulp), which besides the rich ore particles also contains the gangue. This process step is referred to as the "load" process 2 below. As already shown, the hydrophobizing agent may be used for the hydrophobizing of the recoverable material contained in the ore flow. The ore flow, the hydrophobizing, agent and the magnetite may be mixed together ("load process"). A mixing device or an agitator vessel 26 may be provided for this process, which may be designed such that there are sufficient shearing threes and dwell time to enable the hydrophobizing reaction and the combination of magnetite and ore particles to take place.

One possible embodiment is an agitator vessel 26, in which such an agitator with high shearing forces is used. The chemicals and the magnetite are in this case dosed in the vicinity of the agitator. Such an agitator must also be able to ensure not only local but also global mixing. As an alternative, an additional mixer which in addition circulates the fluid can also be used. Large particles (agglomerates) arise in the process, which consist of hydrophobed resin and hydrophobed magnetite.

According to box 3, a separation of the ore into two material flows then takes place, in particular of the sulfide rich ore content of the gangue. In this method step, besides the material "tailing" flow (i.e. the gangue largely relieved of the rich ore content), the "raw concentrate" recoverable material flow is generated. Whereas tailing, as in the currently used flotation method, can be stored directly, the raw concentrate must be further dressed in order in particular to recover the magnetite used and to dress the copper mineral content accordingly for the subsequent additional processing steps.

To this end according to box 4 first the water is removed; if appropriate, an additional drying process may take place. According to box 5, the mixture of hydrophobic copper sulfide and magnetite is fit for transportation, a portion of gangue still being present in the raw concentrate as an impurity.

In additional method steps the magnetite content and the rich ore content are separated from each other (this is known as the "unload" process). As a result, two material flows in turn are generated:

- the magnetite flow, which is added to the pulp in the inlet area of the arrangement (box 1);
- the so-called concentrate, which consists mainly of sulfide copper minerals and a certain proportion of gangue.

In addition, fresh, hydrophobed magnetite is added to the magnetite flow thus obtained from recycled magnetite, in order to replenish the inevitable material losses in the overall process. As a result the demand for comparatively expensive magnetite during execution of the method is minimized, wherein the fresh magnetite is supplied in containers (e.g. "big bags") and can be dosed as appropriate. In some embodiments the additional requisite chemicals are not added in dissolved form until this flow. The chemicals may be added in dissolved form because the dosage and transport of liquids can be performed in the system more homogenously, rapidly and precisely than the dosage of solids.

In the lower part of FIG. 1 the separation of the copper sulfide-magnetite mixture is clarified with the aid of boxes 6 to 9. A non-polar liquid must be added to the mixture of sulfide copper minerals, magnetite and gangue, as can be realized for example by diesel oil.

Box 6 contains the supply of diesel oil to the final product according to box 5 and a mixture of both substances in this connection. As a result the agglomerates of sulfide minerals and magnetite are broken up and the opportunity created to recover the magnetite and generate the actual product "concentrate" without any magnetite component.

In further method steps diesel oil on the one hand and magnetite on the other hand are regenerated for further use. In accordance with the dotted line with associated arrow, the magnetite, part of the gangue remaining in the raw concentrate, and diesel oil are returned to the input step.

Figure 2:
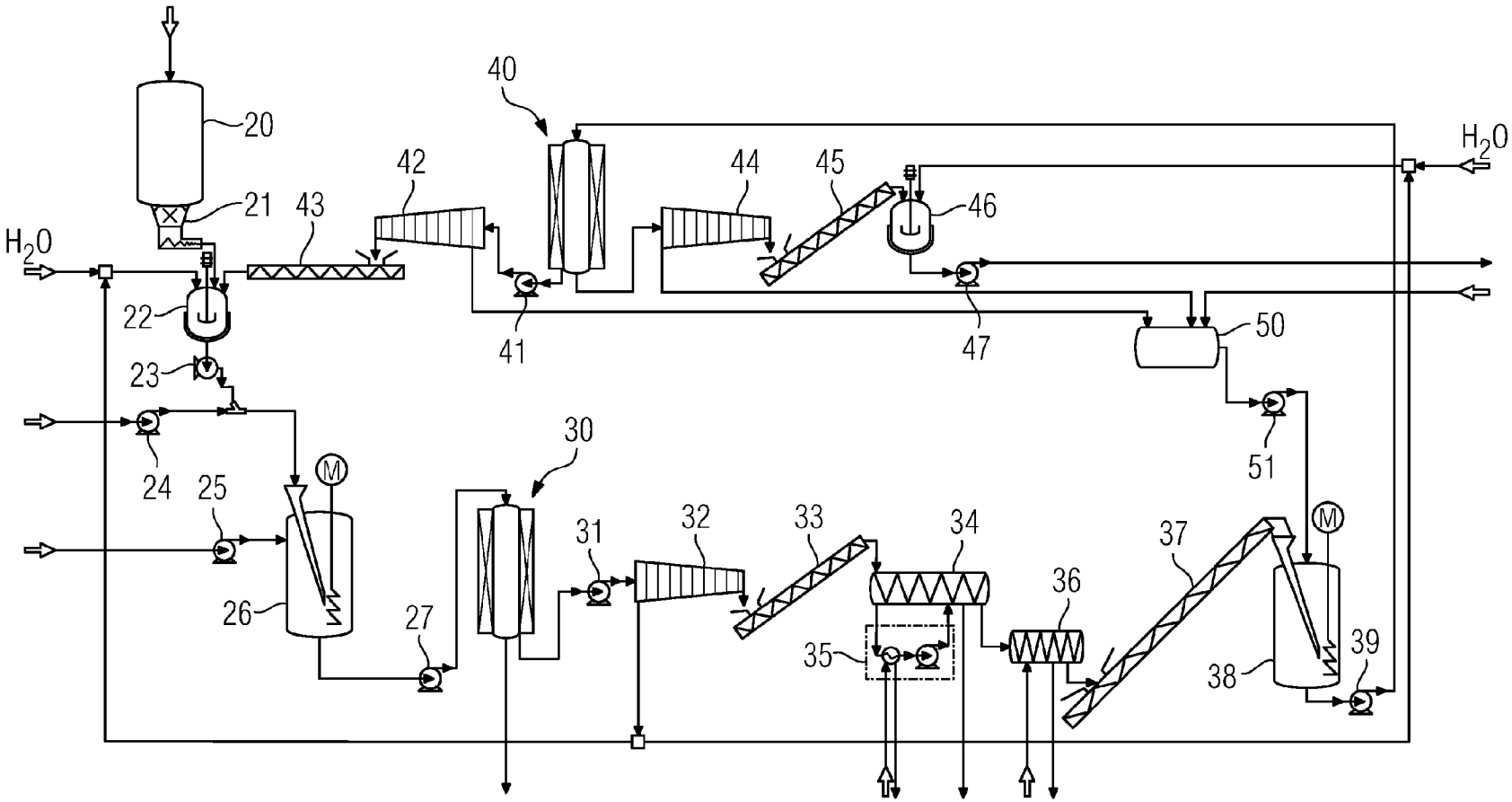
FIG. 2 shows an example implementation of the method shown in FIG. 1 in an overall system, according to an example embodiment.

An example of an operating method of the system for the performance of the method is clarified in FIG. 2 on the basis of the sequence of all units/devices. Here reference character 20 means the container ("big bag") for the magnetite with a dosing device 21. In a first process track the magnetite is mixed with water and recycled magnetite in an agitator device 22. The mixture reaches an agitator device 26 via a dosing pump 23, xanthate being added to the mixture via a second dosing pump 24. In a second process line the recoverable materials in the form of the pulp containing ore is supplied to the agitator device 26 via an additional dosing pump 25. The pulp and the mixture containing xanthate is mixed in the agitator device 46. The agitator device 26 is designed as a reactor and the "load" process is performed in it.

In the overall system according to FIG. 2 there are two magnetic separators 30, 40, i.e., the process runs in parallel on two process levels. The magnetic separators 30, 40 operate according to the same physical principles. Each is assigned one dosing pump 27 or 39, which is responsible for transporting the pulp. The aim of the magnetic separators 35 and 40 is for each to obtain a concentrate with a higher copper content.

According to a first process, the mixture of ore and magnetite is fed to the separation process, for which a dosing pump 27 is used. In the actual separation process, the magnetic agglomerates is separated from the ore flow, wherein separate material flows arise, namely

- a so-called tailing flow, which represents a water-rich flow, and which—depending on use—either does not contain any more recoverable material and can therefore be disposed of. However, this flow may still contain residual recoverable material and is therefore returned for renewed processing.
- the separated flow ("raw concentrate") contains the recoverable material as an intermediate product in a comparatively high concentration. This flow may contain a recoverable material percentage by mass of at least 10% and is an intermediate product flow.

The latter intermediate flow is subsequently routed to a drying step with the aid of at least one dosing pump 31. Drying can, if appropriate, be carried out in two steps. In the first step most of the water is removed with the aid of a mechanical process, in particular by centrifugal forces. Depending on the process, this water can be returned to the process, thus producing a largely closed water circuit with little impact on the environment. The separated water can, however, also be fed back into the pulp preparation directly.

A further possible use is admixture with the final product to make the latter fit for transportation and if appropriate to eliminate the effect of slight residual moisture from diesel.

A possible embodiment for the first dewatering step is the use of the decanter unit 32 according to FIG. 2. This produces the aforementioned intermediate product flow which still has a maximum residual moisture percentage by mass of 10 to 30%. This flow can, if appropriate, be taken to a second drying step e.g. with the aid of a flexible screw conveyor 33 or a conveyor belt. This involves, for example, a thermal dryer 34, which evaporates the remaining moisture. This dryer can, for example, be operated by process steam or gas or oil burners. This produces steam which can be used at other locations for pre-heating.

The latter step may be superfluous depending on the application and process. The dryer produces a solid flow with residual moisture of less than 1%. This flow is cooled in a solid heat exchanger 36 and is added to a further agitator vessel 38, for example, with the aid of a screw conveyor 37.

In an advantageous arrangement the three process steps (basic moisture removal drying dissipation of heat) may be integrated into a single process unit so that the number of devices to be used in this step may be reduced from three to one. In the agitator vessel 38 according to FIG. 2, which may have a similar construction to the first agitator vessel 26, the additional chemicals, in particular the non-polar liquid such as diesel, are admixed with the solid flow. Chemicals may be chosen which remove the hydrophobic bond between the recoverable material and the magnetite, diesel being an ideal option. The diesel flow, which is admixed each time, may contain the recycled diesel oil and a fresh proportion of diesel oil to compensate for material losses in the overall process. In some embodiments, the diesel content is at least 40 percent by mass to enable the mixture to flow and be pumped. The mixture containing the dies may be routed by at least one dosing pump 39 to the subsequent separation step, in which the magnetite particles are separated from the rich ore. The "unload process" may comprise a further magnetic separation. This may separate the magnetite from the material flow, in order to then be supplied to the "load process" again. Two material flows may arise in turn: one flow contains the recoverable material (ore) and moisture is removed from it with the aid of the decanter 44. Depending on requirements, a further thermal dryer can be used. Afterwards this mass flow may be put into an agitator vessel 46 with the aid of conveyor devices 45, mixed with water and output as a final product "concentrate" via a pump 47.

Moisture may likewise be removed from the magnetite flow with the aid of a decanter 42. Here to depending on the application—additional thermal drying steps can be included. Recovered diesel oil may in turn be supplied to the actual process, e.g. via the container for diesel oil 50 and pump 51. The dry magnetite can be transported via a screw conveyor 43 to the agitator device 22. There the recycled magnetite may be mixed with fresh magnetite and water and then returned to the material flow.

What is claimed is:

1. A method for magnetic ore separation and/or dressing, in which metalliferous recoverable materials are separated from conveyed metalliferous ore rock, comprising:

producing a pulp comprising a liquid mixture comprising water and ground rock, the pulp including at least one metalliferous recoverable material, executing a hydrophobizing reaction of the at least one recoverable material in the pulp, synthesizing a hydrophobized, magnetizable material in liquid suspension and adding this suspension to the pulp, causing an agglomeration reaction between hydrophobized magnetizable material and hydrophobized recoverable material to form magnetizable agglomerates in the pulp, performing a first magnetic separation stage to separate the magnetizable agglomerates from the pulp, mixing one of the separation products of the first magnetic separation stage, containing the agglomerates, with a non-polar liquid insoluble in water and decomposing the agglomerates in the non-polar liquid into the basic components of magnetizable material and at least one recoverable material, performing a second magnetic separation stage to separate the magnetizable material from the at least one recoverable material, removing moisture from the separation portion containing the at least one recoverable material of the second separation stage to synthesize the at least one recoverable material.

2. The method of claim 1, wherein the magnetizable material is magnetite ($Fe_3O_4$).

3. The method of claim 1, wherein a hydrophobizing agent is used for selective hydrophobization of the metalliferous recoverable materials of the pulp.

4. The method of claim 1, wherein the non-polar liquid is diesel oil.

5. The method of claim 1, wherein at least one of magnetizable material, non-polar liquid, and process water, are recycled.

6. The method of claim 1, wherein moisture is removed from a material flow of the second magnetic separation stage and the magnetizable material from the material flow from which moisture is removed is used to form the suspension.

7. The method of claim 3, wherein xanthates are used as hydrophobizing agents.

8. The method of claim 1, wherein the pulp has a water content of 30 to 60 percent by mass.

9. The method of claim 1, wherein the pulp is pumped.

10. The method of claim 1, wherein additional chemicals are used in the pulp.

* * * * *